US006196955B1

(12) United States Patent
Chuang

(10) Patent No.: US 6,196,955 B1
(45) Date of Patent: Mar. 6, 2001

(54) PUSH AND PULL SIMULATING EXERCISER

(76) Inventor: Jin Chen Chuang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/442,127

(22) Filed: Nov. 15, 1999

(51) Int. Cl.[7] ..... A63B 21/22
(52) U.S. Cl. ..... 482/132; 482/127; 482/907
(58) Field of Search ..... 482/127, 132, 482/907, 116, 126, 121

(56) References Cited

U.S. PATENT DOCUMENTS 2,821,394 * 1/1958 Barbeau ..... 482/127
3,708,164 * 1/1973 Griffin ..... 482/127
3,752,475 * 8/1973 Ott ..... 482/127
5,707,325 * 1/1998 Chiou ..... 482/132
6,017,296 * 1/2000 Tang et al. ..... 482/132

* cited by examiner

*Primary Examiner*—Jerome Donnelly
(74) *Attorney, Agent, or Firm*—Charles E. Baxley

(57) ABSTRACT

An exerciser has a rod engaged through a frame, and a wheel rotatably engaged on the rod and having one or more holes for threading a resilient belt which is received in the rod and which has two ends retained to the ends of the rod. The middle portion of the belt is engaged through either of the holes of the wheel and may be wound around the rod when the wheel is rotated relative to the rod. The frame has one or more wheels for facilitating moving of the frame and has one or more pulleys for winding the belt. Two pulleys are rotatably engaged on the rod for winding the belt.

9 Claims, 3 Drawing Sheets

PUSH AND PULL SIMULATING EXERCISER

BACKGROUND OF THE INVENTION

1. Field of the Invention

The present invention relates to an exerciser, and more particularly to an exerciser for conducting pushing and pulling simulating exercises.

2. Description of the Prior Art

Typical pushing and pulling exercisers comprise a wheel rotatably engaged on a rod or a handle. The user may hold the handle and may move the handle forward and rearward with the wheel. However, no spring biasing members may be used for recovering the exerciser.

The present invention has arisen to mitigate and/or obviate the afore-described disadvantages of the conventional pushing and pulling exercisers.

SUMMARY OF THE INVENTION

The primary objective of the present invention is to provide a pushing and pulling simulating exerciser including a spring biasing member for recovering the exerciser.

In accordance with one aspect of the invention, there is provided an exerciser comprising a frame, a rod engaged through the frame, the rod including two ends, a first wheel rotatably engaged on the rod and including at least one first hole formed therein, and a resilient belt received in the rod and including two ends retained to the ends of the rod, the resilient belt including a middle portion engaged through the first hole of the first wheel. The belt may be wound around the rod when the first wheel is rotated relative to the rod.

The frame includes at least one second wheel secured thereon for facilitating moving of the frame. The frame further includes at least one pulley rotatably secured thereon for winding the belt therearound. The frame further includes at least one casing formed thereon for rotatably receiving the pulley.

Two stops are further secured to the ends of the belt and engaged with the ends of the rod for retaining the ends of the belt to the ends of the rod. The first wheel includes at least one second hole formed therein for selectively threading the belt.

Two pulleys are further rotatably engaged on the rod for winding the belt therearound. The pulleys each includes a hole formed therein for threading the belt. The pulleys each includes a peripheral portion having an aperture formed therein and communicating with the hole of the pulley for threading the belt.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 5:
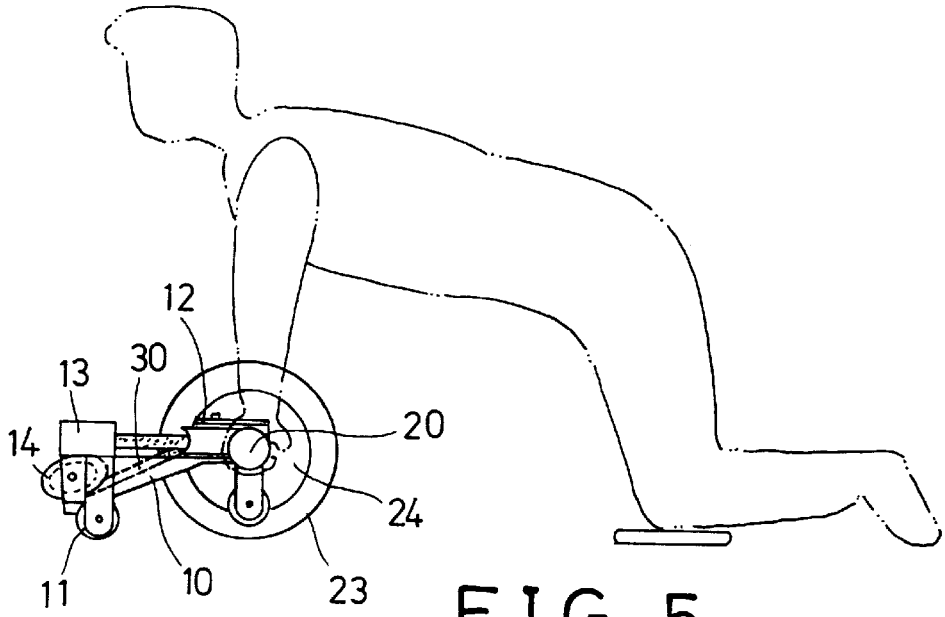
FIGS. 5 and 6 are plane views illustrating the operation of the pushing and pulling simulating exerciser.
Figure 6:
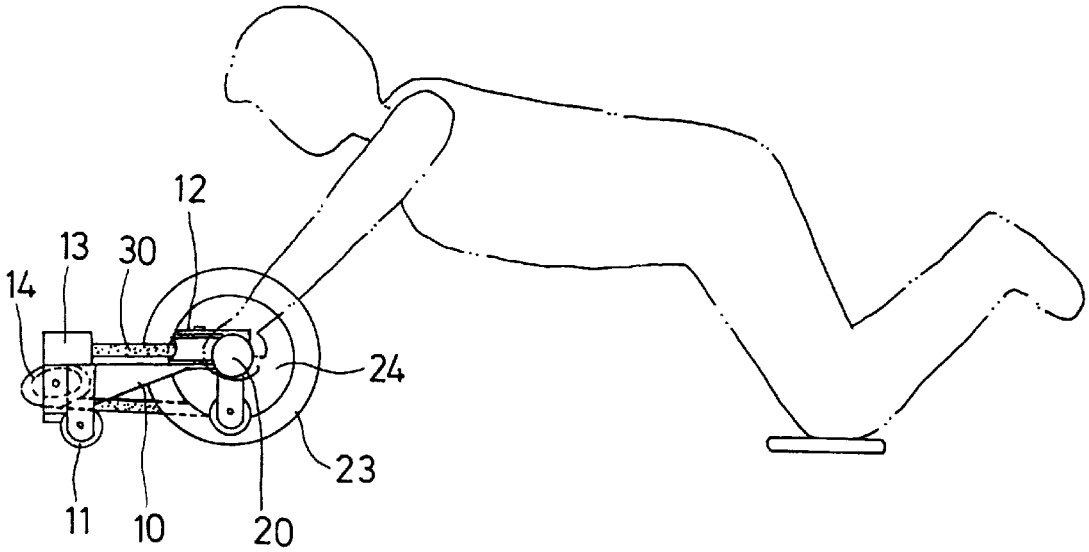

Referring to the drawings, and initially to FIGS. 1–4, a pushing and pulling simulating exerciser in accordance with the present invention comprises a frame 10 including one or more wheels 11 attached to the bottom portion thereof for allowing the frame 10 to be easily moved. The frame 10 is shown to have a square or rectangular shape, but may also be shaped to the other shapes, such as circular, hexagonal etc. The frame 10 includes one or more casings 12, 13 formed therein each for rotatably receiving a pulley 14 therein. It is preferable that one pair of the casings 12 are disposed on one side, such as the rear side (FIGS. 5, 6) of the frame 10, and the other pair of casings 13 are disposed on the other side, such as the front side of the frame 10. Alternatively, the pulleys 14 may be directly and rotatably supported on the frame 10 without the casings 12, 13.

Figure 4:
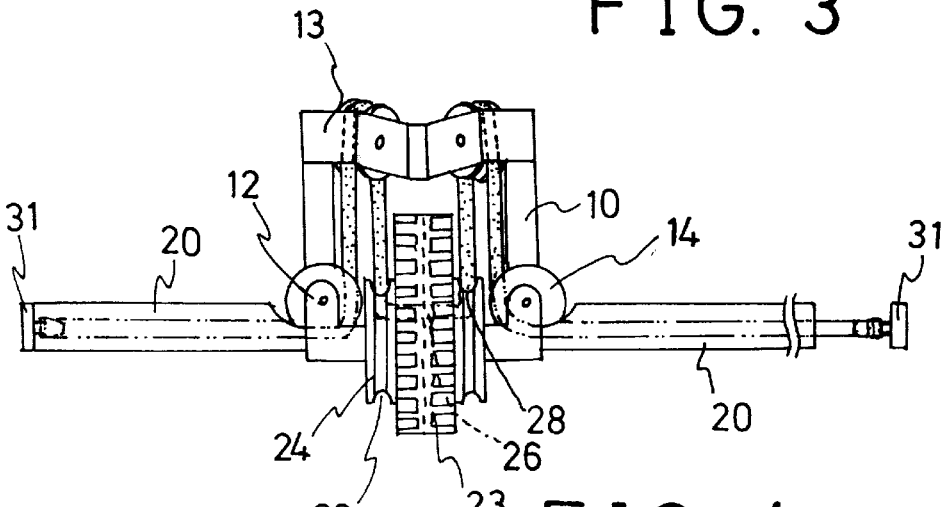
FIG. 4 is a top plane view of the pushing and pulling simulating exerciser.

A rod 20 is engaged through the frame 10, such as the rear portion of the frame 10 and secured to the frame 10 with such as the fasteners 21. The rod 20 includes a hollow interior for receiving a resilient belt 30 therein (FIG. 4). The resilient belt 30 includes two ends each secured to a stop 31 by such as fastener straps. The stops 31 include a size no less than the inner diameter of the rod 20 for engaging with the rod 20 and for securing the ends of the resilient belt 30 to the ends of the rod 20. The rod 20 includes one or more notches 22 formed therein for receiving a portion of the pulleys 14 that are received in the casings 12 and that are supported in the rear portion of the frame 10, such that the middle portion of the resilient belt 30 may be extended outward of the rod 20 and may be engaged over the pulleys 14.

A wheel 23 and two pulleys 24 are rotatably engaged on the rod 20 and are preferably disposed between the casings 12, and each includes one or more holes 26, 27 formed therein. The pulleys 24 each includes a peripheral groove 29 formed therein and an aperture 28 formed in the peripheral portion thereof and communicating with the peripheral groove 29 and the holes 26, 27 (FIGS. 1, 4) for receiving the resilient belt 30. The belt 30 may be engaged into either the holes 26 or the holes 27 of the wheel 23 and the pulleys 24, via the apertures 28, for adjusting the tightness or the strength of the resilient belt 30.

As best shown in FIG. 4, the ends of the belt 30 are retained to the ends of the rod 20, and the middle portion of the belt 30 is engaged over the pulleys 14 and engaged through either the holes 26 or the holes 27 of the wheel 23 and the pulleys 24, via the apertures 28, such that the wheel 23 and the pulleys 24 rotate in concert with each other. When the user hold and push and pull the rod 20, the wheel 23 and the pulleys 24 may be rotated about the rod 20, such that the belt 30 may be wound around the pulleys 24 (or relatively wound around the rod 20) and received in the peripheral grooves 29 of the pulleys 24. Or, without the pulleys 24, the belt 30 may be directly engaged around the rod 20. The belt 30 may thus be stretched and wound around the pulleys 24 and may rotate the wheel 23 and the pulleys 24 backward when the rod 20 is released or when the user do not apply the force against the rod 20.

Figure 1:
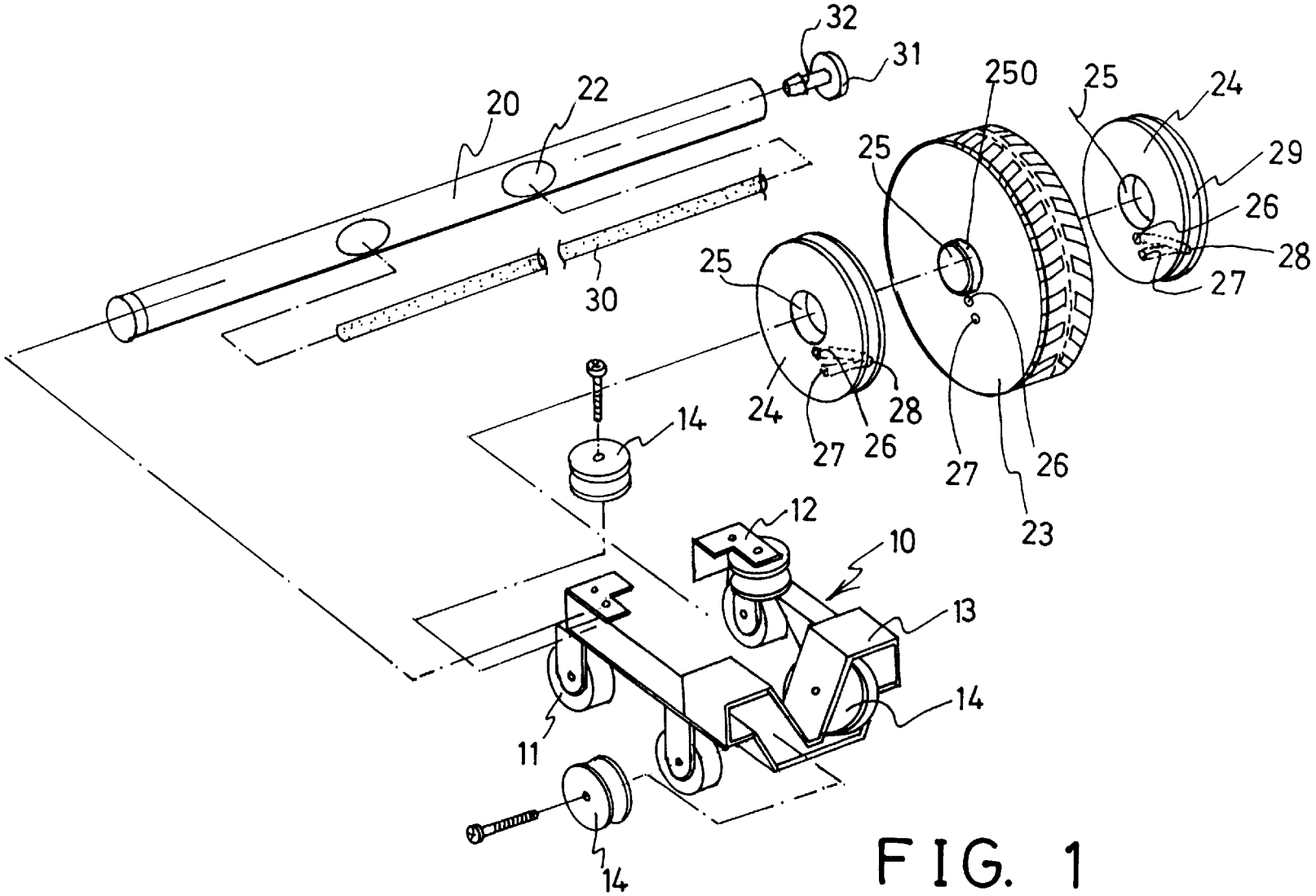
FIG. 1 is an exploded view of a pushing and pulling simulating exerciser in accordance with the present invention.
Figure 2:
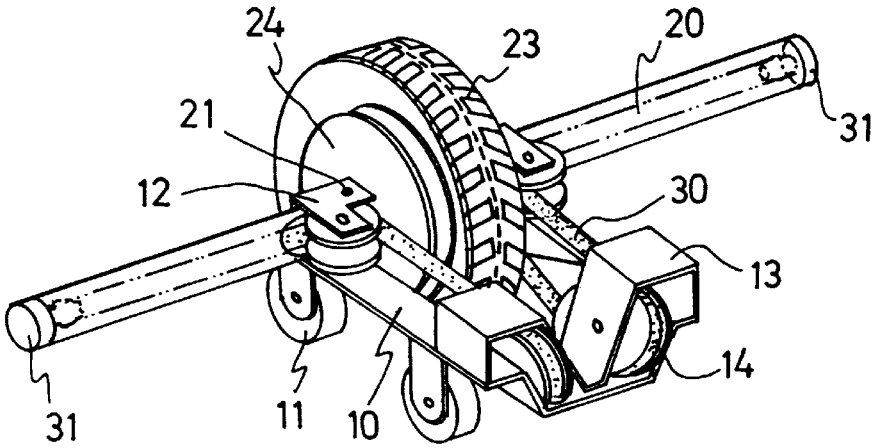
FIG. 2 is an upper perspective view of the pushing and pulling simulating exerciser.
Figure 3:
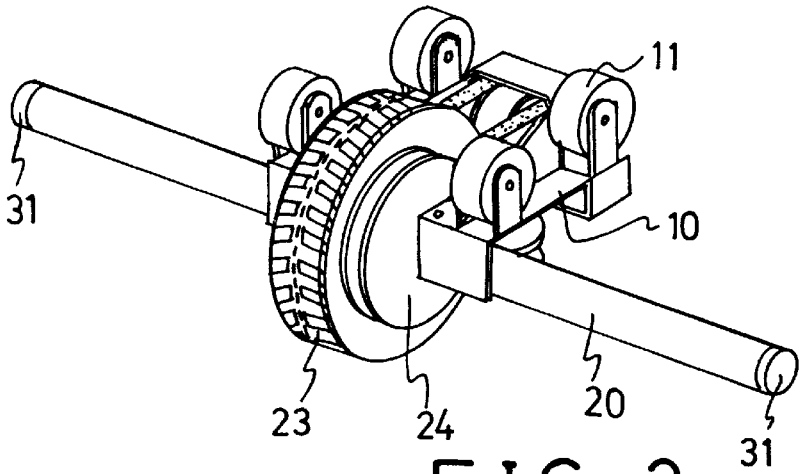
FIG. 3 is a bottom perspective view of the pushing and pulling simulating exerciser.

It is to be noted that the wheels 11 are provided for new learners. For a veteran user, none or only one wheel 11 is good enough for allowing the user to operate the pushing and pulling simulating exerciser. Accordingly, the user may detach the wheels 11 from the frame 10 when required. Instead of the four pulleys 14, the other guide devices or guide tubes or guide members may be used for guiding the belt 30 to be wound around the pulleys 24. Or, the belt 30 may also be directly engaged into the apertures 28 of the pulleys 24 without the pulleys 14. Without the pulleys 24, the belt 30 may also be directly engaged around the rod 20. The wheel 23 and the pulleys 24 may be formed as an integral member. Or, the grooves 29 may be directly formed in the peripheral portion of the wheel 23 for receiving the belt 30. As shown in FIG. 1, the wheel 23 may further include two hubs 250 laterally extended outward therefrom. The pulleys 24 may then be force-fitted onto the hubs 250 of the wheel 23 for being securd onto the wheel 23 and rotated in concert with the wheel 23.

Accordingly, the pushing and pulling simulating exerciser in accordance with the present invention includes a spring biasing member for recovering the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a) a frame, b) a rod engaged through said frame, said rod including two ends, c) a first wheel rotatably engaged on said rod and including at least one first hole formed therein, and d) a resilient belt received in said rod and including two ends retained to said ends of said rod, said resilient belt including a middle portion engaged through said at least one first hole of said first wheel, said belt being wound around said rod when said first wheel is rotated relative to said rod.

2. The exerciser according to claim 1, wherein said frame includes at least one second wheel secured thereon for facilitating moving of said frame.

3. The exerciser according to claim 1, wherein said frame further includes at least one pulley rotatably secured thereon for winding said belt therearound.

4. The exerciser according to claim 3, wherein said frame further includes at least one casing formed thereon for rotatably receiving said at least one pulley.

5. The exerciser according to claim 1 further comprising two stops secured to said ends of said belt and engaged with said ends of said rod for retaining said ends of said belt to said ends of said rod.

6. The exerciser according to claim 1, wherein said first wheel includes at least one second hole formed therein for selectively threading said belt.

7. The exerciser according to claim 1 further comprising two pulleys rotatably engaged on said rod for winding said belt therearound.

8. The exerciser according to claim 7, wherein said pulleys each includes a hole formed therein for threading said belt.

9. The exerciser according to claim 8, wherein said pulleys each includes a peripheral portion having an aperture formed therein and communicating with said hole of said pulley for threading said belt.

* * * * *